US005435290A

United States Patent [19]

Gopp et al.

[11] Patent Number: 5,435,290

[45] Date of Patent: Jul. 25, 1995

[54] CLOSED LOOP FUEL CONTROL SYSTEM WITH HYSTERESIS

[75] Inventors: Alexander Y. Gopp; Charles E. Southwell, both of Ann Arbor, Mich.

[73] Assignee: Ford Motor Company, Dearborn, Mich.

[21] Appl. No.: 161,388

[22] Filed: Dec. 6, 1993

[51] Int. Cl.[6] ..... F02D 41/14

[52] U.S. Cl. ..... 123/694

[58] Field of Search ..... 123/693, 694, 695, 696

[56] References Cited

U.S. PATENT DOCUMENTS

| | | | |
|---|---|---|---|
| 3,939,654 | 2/1976 | Creps | 60/276 |
| 4,117,815 | 10/1978 | Ikeura | 123/691 |
| 4,149,502 | 4/1979 | Johnson et al. | 123/692 |
| 4,350,130 | 9/1982 | Shulman | 123/696 |
| 4,364,356 | 12/1982 | Gerhold | 123/687 |
| 4,402,291 | 9/1983 | Aono | 123/687 |
| 4,811,557 | 3/1989 | Okumura et al. | 60/274 |
| 4,905,469 | 3/1990 | Matsuoka | 60/274 |
| 4,932,383 | 6/1990 | Zechnall et al. | 123/694 |
| 5,115,639 | 5/1992 | Gopp | 60/274 |

*Primary Examiner*—Tony M. Agenbright

*Attorney, Agent, or Firm*—Roger L. May; Peter Abolins

[57] ABSTRACT

A closed loop fuel control system for controlling air/fuel ratio in response to exhaust gas oxygen signals includes a selective hysteresis function to prevent high frequency switching after a noise spike. This improves fuel control system noise protection without introducing permanent time delays.

9 Claims, 4 Drawing Sheets

CLOSED LOOP FUEL CONTROL SYSTEM WITH HYSTERESIS

BACKGROUND OF THE INVENTION

1. Field of the Invention

The invention relates to an air/fuel ratio closed loop fuel control of an internal combustion engine equipped with an Exhaust Gas Oxygen (EGO) sensor.

2. Prior Art

Numerous closed loop fuel control systems are known for controlling the air/fuel ratio to a predetermined (usually stoichiometric) value in response to an EGO sensor. The EGO sensor normally generates an output which changes sharply in amplitude at stoichiometry as a detected oxygen concentration crosses stoichiometry. More particularly, the output of the sensor is high when air/fuel ratio is rich, and the output is low when air/fuel ratio is lean. The output is compared with a reference level that corresponds to a desired air/fuel ratio in the vicinity of stoichiometry to generate an error signal indicative of the deviation from the desired air/fuel ratio. The error signal is assigned the value of 1 for a rich air/fuel ratio, and the value of −1 for a lean air/fuel ratio. The error signal is fed into a fuel controller which is usually a Proportional and Integral (PI) controller. In response to the error signal, the PI controller originates a familiar limit cycle control.

The output of the EGO sensor can be contaminated with a high frequency noise which appears as short duration spikes superimposed on the EGO signal. The noise frequency can correspond to an engine firing frequency, and the sources of noise can be injector fuel flow maldistribution, incomplete combustion, engine ignition system (spark firing), and the like. These spikes (of either induced electrical noise or air/fuel ratio deviation) may cause a false triggering of the error signal and disrupt a limit cycle. Under certain unfavorable conditions, such as a low load during deceleration, fuel control system may lock into this high frequency noise and start switching with the high frequency. It leads to a temporary loss of a fuel control which will recover only after substantial air/fuel ratio errors.

To alleviate this problem, error detection incorporates different noise suppression techniques. One widely used technique includes hardware or software low pass filter (see U.S. Pat. No. 4,149,502 issued to Johnson et al). Another technique described in U.S. Pat. No. 4,811,557 issued to Okumura et al uses time delay to acknowledge the crossing of stoichiometry to make sure that it is not spurious noise induced change. Yet another technique may incorporate a comparator with hysteresis. A common disadvantage of all these approaches is an additional time delay which decreases frequency of the limit cycle.

The object of the present invention is to improve fuel control system noise protection without introducing permanent time delays thus increasing the frequency of the limit cycle.

SUMMARY OF THE INVENTION

This invention overcomes the disadvantages discussed above in connection with the prior art by introducing a non-linear element, providing an enhanced hysteresis, in the error detection. This element can be viewed as a combination of two non-symmetrical hysteresis elements and an additional logic element which chooses one of these two hysteresis elements depending upon previous state conditions of the control system. Thus when a noise spike is not a factor, a control system behaves like a regular control system without any hysteresis. When there is noise, hysteresis is used. If a first switching has been caused by a noise spike, the hysteresis element prevents consequent high frequency switches before an error signal exceeds a preset hysteresis value. Such an enhanced hysteresis element may be incorporated as a control logic circuit, or as a software control algorithm in a microcomputer.

Referring to FIG. 6A (prior art), an EGO sensor output with respect to time shows high frequency amplitude variations on such a scale that the trace is frequently blacked out. The corresponding air fuel control signal shown in FIG. 6B (prior art) shows periodic high frequency amplitude variations which also result in blacked out sections. Applying such a control signal to an air fuel ratio control system magnifies the impact of the high frequency noise signal.

Referring to FIGS. 7A and 7B, the noise signal in the air fuel control signal of FIG. 7B has been substantially eliminated in accordance with an embodiment of this invention. Thus the feedback effect of the control air fuel signal of FIG. 7B on the EGO sensor signal shown in 7A is reduced. Accordingly, the high frequency amplitude variations of FIG. 7A are substantially reduced in comparison to that of FIG. 6A.

DESCRIPTION OF THE PREFERRED EMBODIMENT

Figure 1:
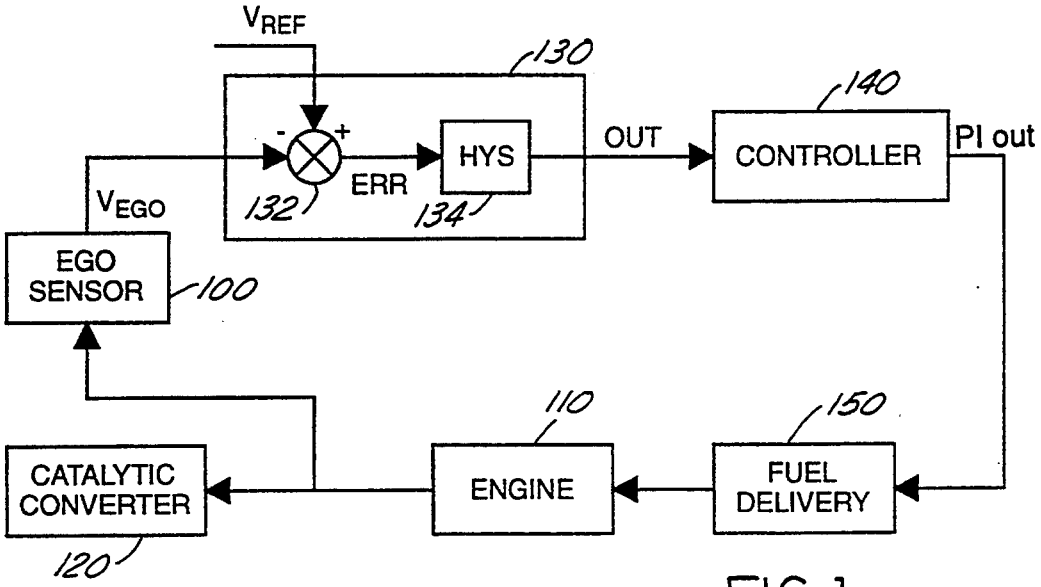
FIG. 1 is a schematic control block diagram of the closed loop fuel control system in accordance with an embodiment of this invention.

Referring to FIG. 1, closed loop fuel control system for internal combustion engines comprises an exhaust oxygen sensor 100 disposed in the exhaust passage from the internal combustion engine 110 to detect an oxygen concentration in the exhaust and provide an output indicative of the stoichiometric point of the mixture. Specifically, the output from EGO sensor 100 assumes high or low voltage depending upon whether exhaust composition is richer or leaner than stoichiometry respectively. Exhaust gases from engine 110 are discharged through a catalytic converter 120 which removes pollutants from the exhaust. Sensor 100 output is modified through an error detector element 130 and a fuel controller 140. The modified signal (PI out) is fed back to engine 110 through fuel delivery system 150.

Considering error detector element 130 in greater detail, it includes a summing element 132 and an enhanced hysteresis element 134. Summing element 132 calculates the difference signal $ERR = V_{REF} - V_{EGO}$, where $V_{REF}$ is a reference voltage that corresponds to a desired air/fuel ratio in the vicinity of stoichiometry, and $V_{EGO}$ is an output of EGO sensor 100. The signal ERR is fed to the input of hysteresis element 134 which generates output signal OUT equal to 1 or −1 depending on sign and amplitude of signal ERR and the previous value of signal OUT.

Figure 2A:
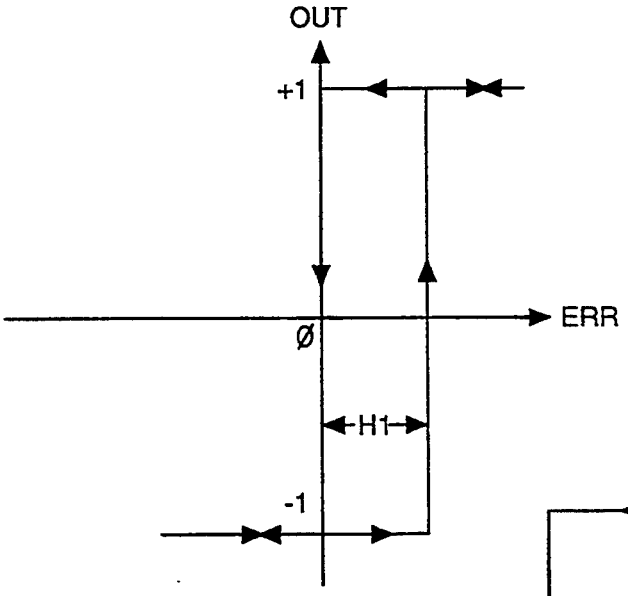
FIG. 2A and 2B are graphical representations showing characteristics of the enhanced hysteresis element according to the invention.
Figure 2B:
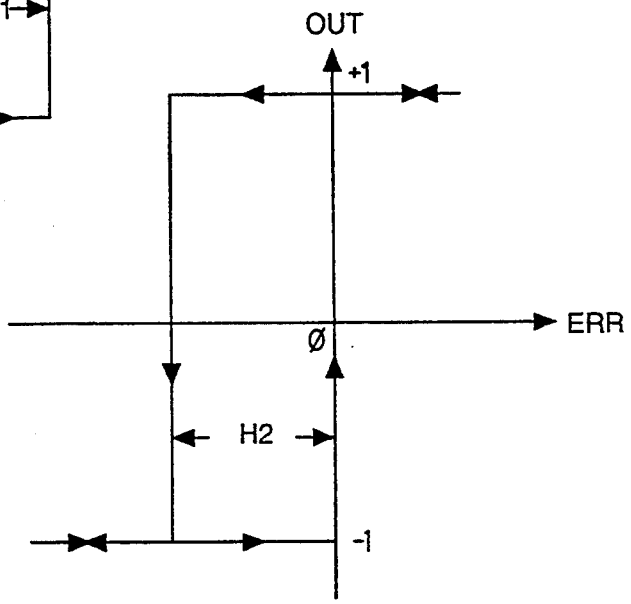

FIGS. 2A and 2B show graphical characteristics describing two non-symmetrical hysteresis elements comprising enhanced hysteresis element 134. In the general case, hysteresis values H1 and H2 may be variable and of unequal values, but their sum, H1+H2, is advantageously controlled to be less than extreme limits of EGO signal $V_{EGO}$ at all engine operating conditions.

The logical expressions associated with the graphical representations of hysteresis elements of FIGS. 2A and 2B are as follows:

$$\text{OUT} = \begin{cases} +1, \text{ If } ERR > H1, \\ \text{or } (0 < ERR \leqq H1 \text{ and } ERR_{PREV} = +1) \\ -1, \text{ If } ERR \leqq 0, \\ \text{or } (0 < ERR \leqq H1 \text{ and } ERR_{PREV} = -1) \end{cases}$$

$$\text{OUT} = \begin{cases} +1, \text{ If } ERR > 0, \\ \text{or } (-H2 < ERR \leqq 0 \text{ and } ERR_{PREV} = +1) \\ -1, \text{ If } ERR \leqq -H2, \\ \text{or } (-H2 < ERR \leqq 0 \text{ and } ERR_{PREV} = -1), \end{cases}$$

and logical conditions to choose one of these two hysteresis elements:

PL=1, If ERR>H1

PL=0, If ERR<−H2

$ERR_{PREV}$=Previous Value of ERR

Figure 3:
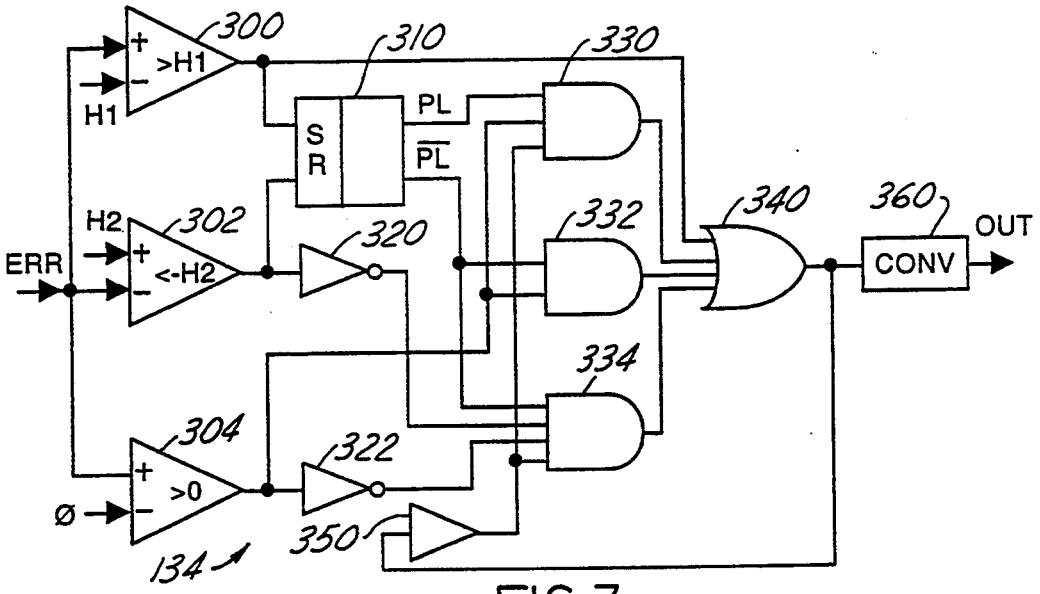
FIG. 3 is a schematic diagram of a control logic circuit in accordance with an embodiment of this invention.

Logical conditions can be better understood from a control logic circuit shown in FIG. 3 which corresponds to an enhanced hysteresis element 134 in FIG. 1. Input signal ERR from summing element 132 (FIG. 1) is applied to one input of three comparators 300, 302, and 304. Reference voltages representing hysteresis values H1 and H2, and 0 volt from voltage sources (not shown) are applied to a second input of comparators 300, 302 and 304 respectively. Each comparator has its output signal equal to 1 (TRUE) if shown condition is met, and O (FALSE) otherwise. R-S flip-flop (latch) 310 represents a memory element which preserves previous state conditions. Its output PL is set to 1 if ERR>H1, and is reset to O if ERR<−H2. Logic NOT gates 320 and 322 are used to invert logical functions when required in accordance with logical conditions indicated above. Logic AND gates 330, 332 and 334 together with logic OR gate 340 define logical conditions to determine which hysteresis function of hysteresis elements 134 is to be used. Output of a logic delay gate 350 represents previous logic value of the output signal of gate 340. Finally, converter element 360 converts logical output of gate 340 into a control signal OUT having 1 or −1 value provided to controller 140 in FIG. 1.

Figure 4A:
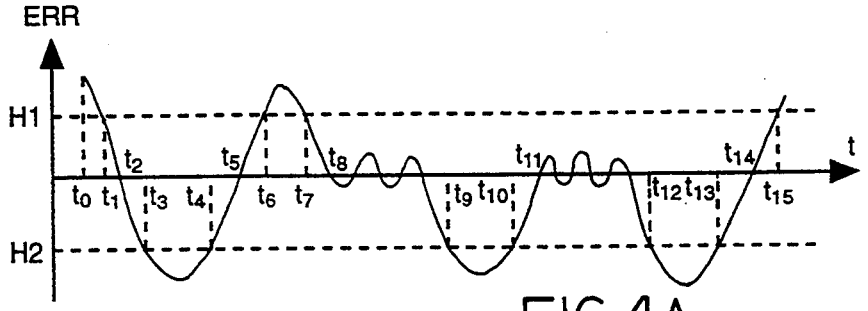
FIG. 4A, 4B and 4C are timing diagrams explaining the functioning of the enhanced hysteresis element.
Figure 4B:
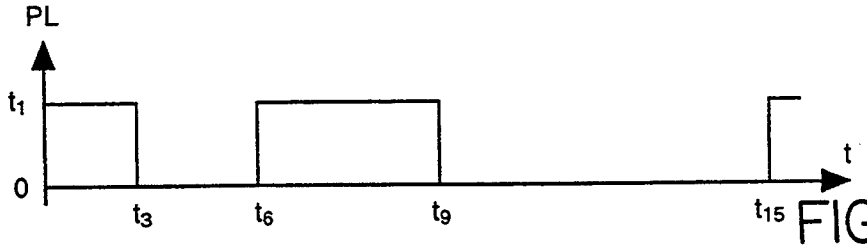
Figure 4C:
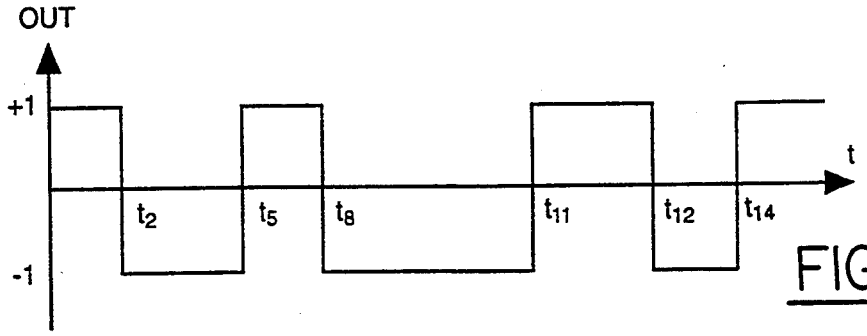

The operation of the control logic of FIG. 3 will be further explained with reference to FIGS. 4A through 4C. FIG. 4A illustrates a possible error signal ERR, and dashed lines represents preset hysteresis values H1 and H2. When signal ERR crosses these dashed lines at times t3, t6, t9 and t15, R-S latch 310 switches as shown in FIG. 4B.

The control logic description starts at time t0, when ERR>H1. This condition sets comparator 300, latch 320, OR gate 340, and converter 360 to 1 (FIG. 4C). When ERR signal decreases such as O<ERR<H1 (between times t1 and t2), converter 360 output is kept at 1 by logic AND gate 330 which has all 3 inputs TRUE. However, when ERR crosses O at time t2, comparator 304 indicates FALSE conditions, and gates 330 and 332 are reset to O. Gate 334 is kept at O by logic variable PL=O. These conditions reset OR gate 340 to O, and converter 360 to −1 (FIG. 4C). As explained earlier, R-S latch 310 is reset to O at time t3 (FIG. 4B), but converter output is kept at −1 because gate 334 is kept at O by output of gate 350 representing the previous value of the output signal of OR gate 340 (FIG. 4C). The output of R-S latch 310 does not change at time t4. At time t5, ERR signal becomes ERR>O, and both inputs to gate 332 become TRUE, thus switching outputs of gate 340 and converter 360 to 1. Converter 360 is kept at 1 between time t5 and t8, and after time t8 switches to −1 as explained above. It means that when input signal ERR is not contaminated by noise and crosses both hysteresis values H1 and H2, output signal OUT switches from 1 to −1 and back at times when ERR crosses O level as it should be without any hysteresis.

Between times t8 and t9, ERR signal crosses O level several times without crossing hysteresis values H1 or H2. However, AND gates 330, 332, and 334 are kept at O all the time by FALSE conditions from R-S latch 320 or previous low state from gate 350. At time t9, R-S latch 310 switches to O, thus enabling converter 360 to switch to 1 at time t11 upon crossing O level by ERR signal. Using an analogous explanation, output signal OUT remains equal to +1 between times t11 and t12 in spite of several crossing of the O level by ERR signal. If no noise is present after time t12, enhanced hysteresis reverts to no hysteresis, and switches back and forth at each O level crossing by ERR signal.

Figure 5:
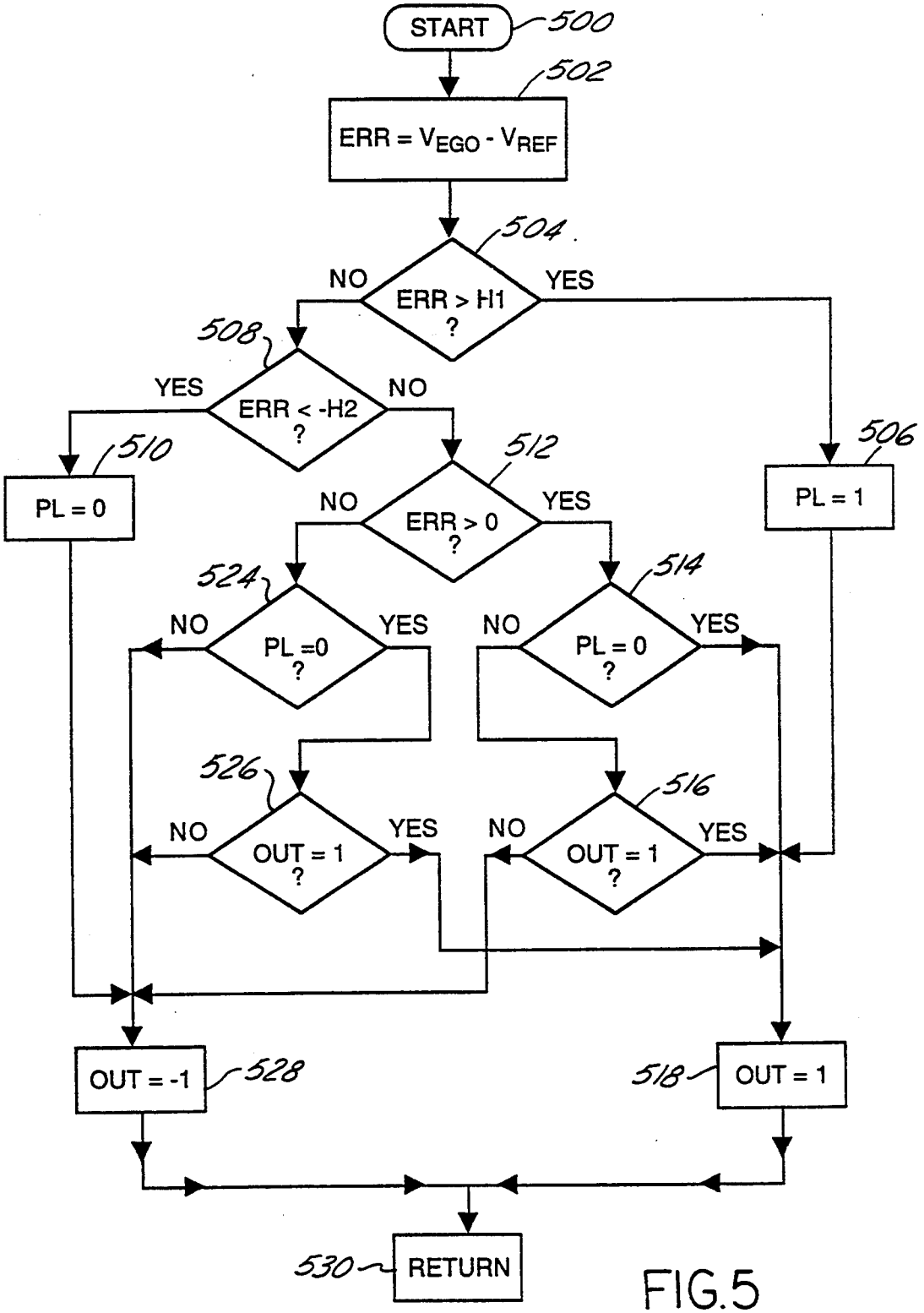
FIG. 5 is a flowchart illustrating various process steps performed to calculate output of the enhanced hysteresis element in accordance with an embodiment of this invention.
Figure 6A:
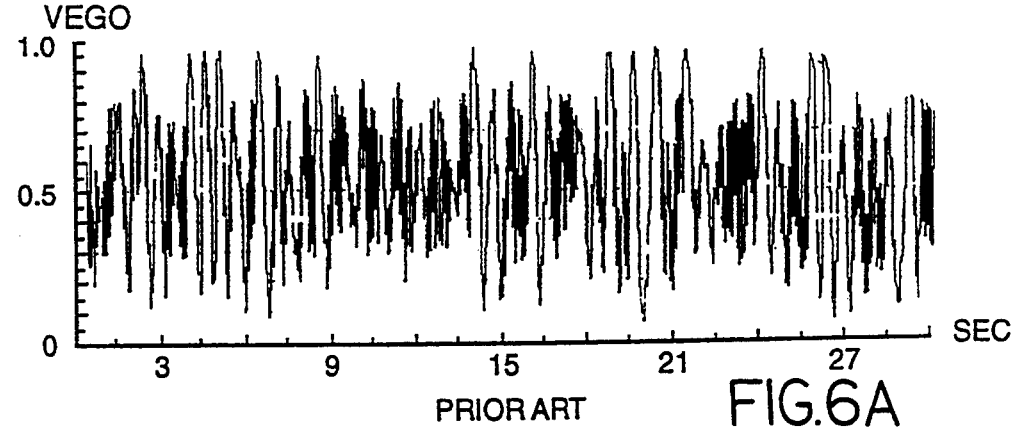
FIGS. 6A and 6B are a graphical representation of EGO sensor output and corresponding air/fuel control signal, in accordance with the prior art.
Figure 6B:
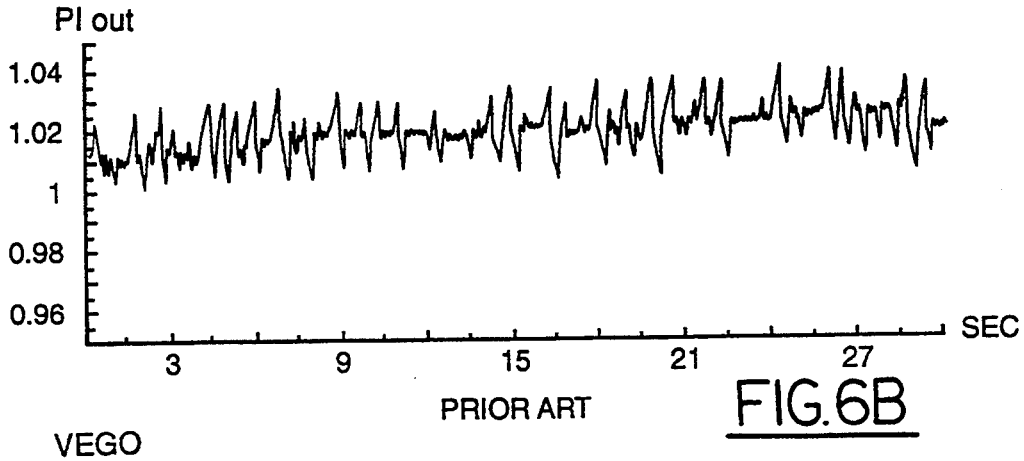
Figure 7A:
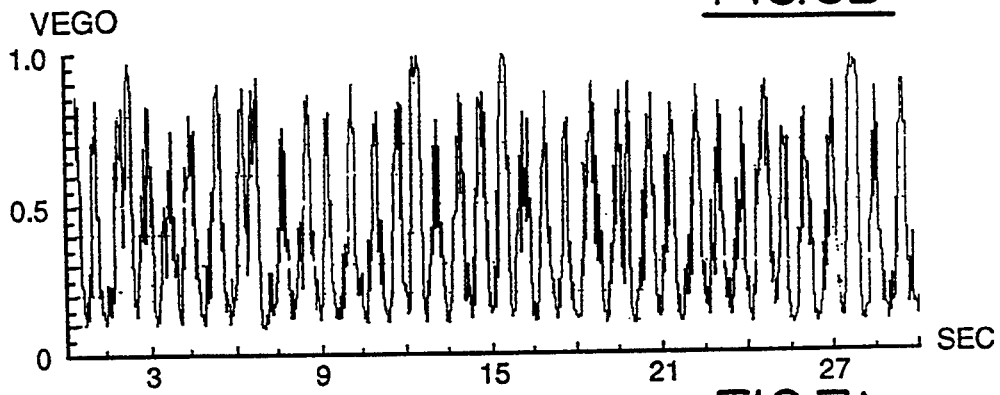
FIGS. 7A and 7B are a graphical representation of EGO sensor output and corresponding air/fuel control signal in accordance with an embodiment of this invention.
Figure 7B:
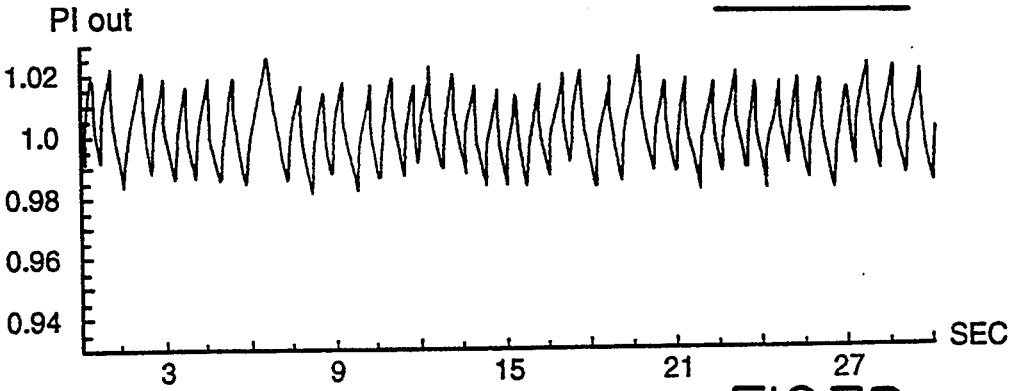

Another embodiment of the present invention is shown in FIG. 5 representing a logic flow diagram suitable for microcomputer applications. After entering the logic flowchart in step 500, step 502 calculates error signal ERR. Step 504 checks if ERR>H1, and if the answer is YES, sets in step 506 latch signal PL to 1, goes to step 518 to set signal OUT equal to 1 and exits flowchart in step 530. If the answer in step 504 is NO, step 508 checks if ERR<−H2. If the answer in step 508 is YES, step 510 sets PL equal to O. Logic flow then goes to step 528 where signal OUT is set to −1, and then to a return step 530. The NO answer in step 508 means that H1≧ERR≧−H2. Flowchart steps 512 through 528 correspond to similar logical conditions in control logic shown in FIG. 3.

This concludes the description of the preferred embodiment. The reading of it by those skilled in the art will bring to mind many further alterations and modifications without departing from the spirit and scope of the invention. Accordingly, it is intended that the scope of the invention be limited to only the following claims.

What is claimed:

1. A closed loop fuel control system for supplying a variable air/fuel ratio to an internal combustion engine which generates combustion exhaust gases comprising:

sensor means for sensing the oxygen concentration in the exhaust gas to generate an oxygen signal having a value indicative of the air/fuel ratio of the exhaust gases;

a latch circuit responsive to a first signal to switch to a first state and responsive to a second signal to switch to a second state;

a first comparator responsive to said oxygen signal having a value greater than a first limit to generate said first signal;

a second comparator responsive to said oxygen signal having a value less than a second limit to generate said second signal;

a third comparator responsive to said oxygen signal having a value greater than a value intermediate said first limit and said second limit to generate a third signal;

a first gate responsive to said latching circuit being in said first or second state, said third signal and a fourth signal to generate a first gate output;

a second gate responsive to said latching circuit being in said first or second state and said third signal to generate a second gate output;

a third gate responsive to said latching circuit being in said first or second state, an inverted value of said second signal, an inverted value of said third signal and said fourth signal to generate a third gate output;

an OR gate responsive to said first signal, said first gate signal, said second gate signal and said third gate signal to generate said fourth signal; and means for controlling the fuel being delivered to the internal combustion engine in response to said fourth signal.

2. The closed loop fuel control system of claim 1 further including an error detector circuit for generating an error signal having a value equal to said oxygen signal minus a reference signal, said reference signal having a value corresponding to a desired air/fuel ratio and wherein:

said first, second and third comparators compare said error signal to said first limit, said second limit and said value intermediate said first and second limits respectively.

3. The closed loop fuel control system of claim 2 wherein said first limit has a positive value, said second limit has a negative value and said value intermediate said first and second limit is approximately equal to zero.

4. The closed loop fuel control system of claim 1 further including a converter circuit disposed between said OR gate and said means for controlling the fuel to the engine, said converter circuit responsive to said fourth signal to generate a positive output signal when the output of said OR gate has a positive value and to generate a negative output signal in response to said OR gate having a zero value, said means for controlling the fuel to the engine, responsive to the polarity of the output signals generated by the converter circuit to control the fuel being delivered to the engine.

5. The closed loop fuel control of claim 1 wherein said first, second and third gates are AND gates.

6. A hysteresis circuit for a closed loop fuel control system supplying a variable air/fuel ratio to an internal combustion, said system including an oxygen sensor responsive to the oxygen content of the exhaust gases of the internal combustion engine to generate an oxygen signal, said hysteresis circuit comprising:

first circuit means for generating a first output signal in response to an input signal having a value greater than a first predetermined value, said input signal having a value which is a function of said oxygen signal;

second circuit means for generating said first output signal in response to said input signal having a value greater than an intermediate value and less than or equal to said first predetermined value and a previous output signal having a value equal to said first output signal;

third circuit means for generating a second output signal in response to said input signal having a value equal to or less than said intermediate value and said previous output signal having a value equal to second output signal;

fourth circuit means for generating said second output signal in response to said input signal having a value greater than said intermediate value and said previous output signal having a value equal to said second output signal;

fifth circuit means for generating said first output signal in response to said input signal having a value greater than said intermediate value and the previous output signal having a value equal to said first output signal;

sixth circuit means for generating said first output signal in response to said input signal having a value between a second predetermined value and said intermediate value and the previous output signal having a value equal to said first output signal;

seventh circuit means for generating said second output signal in response to said input signal having a value less than said second predetermined value and said previous output signal having a value equal to said second output signal; and eighth circuit means for generating said second output signal in response to said input signal having a value greater than said second value, less than or equal to said intermediate value and said previous output signal having a value equal to said second output signal.

7. The hysteresis circuit of claim 5 wherein said input signal is equal to said oxygen signal.

8. The hysteresis circuit of claim 5 further including an error detector circuit for generating said input signal having a value equal to said oxygen signal minus a reference signal, said reference signal having a value corresponding to a desired air/fuel ratio, and wherein said first predetermined value has a positive value, said second predetermined value has a negative value and said intermediate value is approximately equal to zero.

9. A method of closed loop fuel control for supplying an air/fuel mixture in variable ratios to an internal combustion engine generating exhaust gases, said method comprising the steps of:

sensing the concentration of oxygen in the exhaust gases generated by the engine to generate an oxygen signal having a value indicative of the oxygen content of said exhaust gases;

generating an error signal having a value indicative of the deviation of said oxygen signal from a desired value;

setting a PL signal to 1 in response to said error signal having a value greater than a first predetermined value;

setting said PL signal to 0 in response to said error signal having a value less than a second predetermined value;

setting an output signal equal to 1 in response to said error signal having a value greater than 0 and said PL signal being zero, said output signal having a value signifying the air/fuel mixture being supplied to the engine is richer than a desired air/fuel ratio;

setting said output signal equal to −1 in response to said error signal having a value greater than 0, said PL signal being 1 and a previous output signal having a value equal to 0, said output signal having a value −1 signifying the air/fuel mixture ratio being supplied to the engine is leaner than said desired air/fuel ratio;

setting said output signal equal to 1 in response to said error signal having a value greater than 0, and said PL signal being 0;

setting said output signal equal to 1 in response to said error signal having a value greater than 0, said PL signal being 1 and said previous output signal having a value equal to 1;

setting said output signal to 1 in response to said error signal having a value less than 0, said PL signal being 0, and said previous output signal having a value equal to 1;

setting said output signal equal to −1 in response to said error signal having a value less than 0, said PL signal being 0; and said previous output signal being 0;

setting said output signal equal to −1 in response to said error signal being less than 0, said PL signal being 1 and said previous output signal being −1; and controlling the fuel supplied to the engine in response to said output signal.

* * * * *